US012371226B2

(12) United States Patent
Drechsler et al.

(10) Patent No.: US 12,371,226 B2
(45) Date of Patent: Jul. 29, 2025

(54) CONTAINERS

(71) Applicant: Instant Brands Holdings Inc., Downers Grove, IL (US)

(72) Inventors: Alfonse Drechsler, Downers Grove, IL (US); Steven A. Olesen, Corning, NY (US)

(73) Assignee: Instant Brands Holdings Inc., Downers Grove, IL (US)

( * ) Notice: Subject to any disclaimer, the term of this patent is extended or adjusted under 35 U.S.C. 154(b) by 0 days.

(21) Appl. No.: 17/951,353

(22) Filed: Sep. 23, 2022

(65) Prior Publication Data

US 2023/0113999 A1 Apr. 13, 2023

Related U.S. Application Data

(60) Provisional application No. 63/248,926, filed on Sep. 27, 2021.

(51) Int. Cl.
*B65D 21/08* (2006.01)
*B65D 43/16* (2006.01)
*B65D 51/18* (2006.01)

(52) U.S. Cl.
CPC ..... *B65D 21/086* (2013.01); *B65D 43/164* (2013.01); *B65D 51/18* (2013.01); (Continued)

(58) Field of Classification Search
CPC .. B65D 1/0292; B65D 21/068; B65D 21/086; B65D 45/16; B65D 45/18; B65D 45/22; (Continued)

(56) References Cited

U.S. PATENT DOCUMENTS 3,301,293 A * 1/1967 Santelli ..... B65D 1/0292 297/DIG. 8
4,338,826 A 7/1982 Jacoby et al.
(Continued)

FOREIGN PATENT DOCUMENTS

CN 200963546 Y 10/2007
CN 200992324 Y 12/2007
(Continued)

OTHER PUBLICATIONS

International Search Report and Written Opinion for International Patent Application No. PCT/US22/44510 dated Feb. 8, 2023, 15 pages.

(Continued)

*Primary Examiner* — Andrew T Kirsch
(74) *Attorney, Agent, or Firm* — TUCKER ELLIS LLP

(57) ABSTRACT

A container, includes a collapsible portion and a container base. The collapsible portion has a first step structure; a second step structure; and a hinge assembly coupled between the first step structure and the second step structure. The container base is coupled to the collapsible portion. Another container includes a container base; a collapsible portion, coupled to the container base; a lid base, coupled to the collapsible portion; a ring, coupled to the lid base and sandwiching a periphery of the collapsible portion with the lid base; and a lid assembly, coupled to the ring when the container is in a closed status.

21 Claims, 20 Drawing Sheets

(52) U.S. Cl.
CPC ..... *B65D 2251/0021* (2013.01); *B65D 2251/0084* (2013.01)

(58) Field of Classification Search
CPC ..... B65D 43/0218; B65D 21/08; B65D 43/0208; B65D 43/163; B65D 43/164
See application file for complete search history.

(56) References Cited

U.S. PATENT DOCUMENTS

| | | | | |
|---|---|---|---|---|
| 4,773,458 | A | 9/1988 | Touzani | |
| 5,573,129 | A | 11/1996 | Nagata et al. | |
| 5,911,338 | A * | 6/1999 | Miller | B65D 21/086 220/666 |
| 7,921,769 | B2 | 4/2011 | So et al. | |
| 8,313,000 | B1 | 11/2012 | Tuan | |
| 8,485,388 | B2 | 7/2013 | Tuan | |
| 8,844,764 | B2 | 9/2014 | Curtin et al. | |
| 8,887,942 | B2 | 11/2014 | Miksovsky et al. | |
| 9,016,491 | B2 | 4/2015 | Blum et al. | |
| 9,079,685 | B2 | 7/2015 | Sudakoff | |
| 9,119,507 | B2 | 9/2015 | Abrams et al. | |
| 9,221,582 | B2 | 12/2015 | Wheeler et al. | |
| 9,622,611 | B2 | 4/2017 | Tuan | |
| 9,723,942 | B2 | 8/2017 | Do | |
| 9,730,555 | B1 | 8/2017 | Lee et al. | |
| 9,926,105 | B2 | 3/2018 | Tsui | |
| 9,969,521 | B2 | 5/2018 | Shen | |
| 10,408,522 | B2 | 9/2019 | Tsui | |
| 10,674,848 | B2 | 6/2020 | Feeley et al. | |
| 11,021,182 | B1 | 6/2021 | DeGrazia | |
| 11,026,527 | B2 | 6/2021 | Tsui | |
| 2005/0127074 | A1 | 6/2005 | Kusuma et al. | |
| 2008/0099476 | A1 | 5/2008 | Fung | |
| 2009/0183565 | A1 | 7/2009 | Shamoon et al. | |
| 2012/0205371 | A1 | 8/2012 | Lee | |
| 2012/0217238 | A1 | 8/2012 | Chang | |
| 2013/0264340 | A1 | 10/2013 | Zens | |
| 2013/0284753 | A1 | 10/2013 | Kellmann | |
| 2015/0034661 | A1 | 2/2015 | Cooper et al. | |
| 2015/0041478 | A1 | 2/2015 | Abrams et al. | |
| 2015/0201779 | A1 | 7/2015 | Tittel | |
| 2016/0059990 | A1 | 3/2016 | Patikas-Bryant | |
| 2017/0008670 | A1 | 1/2017 | Wu et al. | |
| 2017/0320611 | A1 | 11/2017 | Shen | |
| 2018/0118410 | A1 * | 5/2018 | Wood | B65D 45/22 |
| 2018/0194517 | A1 | 7/2018 | Brooks | |
| 2019/0075973 | A1 | 3/2019 | Charleson et al. | |
| 2019/0119000 | A1 | 4/2019 | Tsui | |
| 2019/0368799 | A1 | 12/2019 | Tsui | |
| 2020/0231324 | A1 | 7/2020 | Swarts et al. | |
| 2020/0277105 | A1 | 9/2020 | Longo | |
| 2020/0305584 | A1 | 10/2020 | Tuan | |
| 2021/0237933 | A1 | 8/2021 | Swarts et al. | |

FOREIGN PATENT DOCUMENTS

| | | | |
|---|---|---|---|
| CN | 201235967 | Y | 5/2009 |
| CN | 201481821 | U | 5/2010 |
| CN | 201756219 | U | 3/2011 |
| CN | 201996156 | U | 10/2011 |
| CN | 202341586 | U | 7/2012 |
| CN | 202358415 | U | 8/2012 |
| CN | 202358423 | U | 8/2012 |
| CN | 202457003 | U | 10/2012 |
| CN | 202557926 | U | 11/2012 |
| CN | 202567550 | U | 12/2012 |
| CN | 202709217 | U | 1/2013 |
| CN | 203158431 | U | 8/2013 |
| CN | 206079966 | U | 4/2014 |
| CN | 203646953 | U | 6/2014 |
| CN | 204015486 | U | 12/2014 |
| CN | 204191806 | U | 3/2015 |
| CN | 204197535 | U | 3/2015 |
| CN | 204368607 | U | 6/2015 |
| CN | 204394054 | U | 6/2015 |
| CN | 204764780 | U | 11/2015 |
| CN | 204764789 | U | 11/2015 |
| CN | 204970669 | U | 1/2016 |
| CN | 105584708 | A | 5/2016 |
| CN | 105661859 | A | 6/2016 |
| CN | 205667497 | U | 11/2016 |
| CN | 205686774 | U | 11/2016 |
| CN | 205884997 | U | 1/2017 |
| CN | 206062922 | U | 4/2017 |
| CN | 206243692 | U | 6/2017 |
| CN | 206561813 | U | 10/2017 |
| CN | 206606462 | U | 11/2017 |
| CN | 107472635 | A | 12/2017 |
| CN | 206749663 | U | 12/2017 |
| CN | 206923866 | U | 1/2018 |
| CN | 207089913 | U | 3/2018 |
| CN | 207157771 | U | 3/2018 |
| CN | 207253499 | U | 4/2018 |
| CN | 207477319 | U | 6/2018 |
| CN | 207698223 | U | 8/2018 |
| CN | 207721411 | U | 8/2018 |
| CN | 207784602 | U | 8/2018 |
| CN | 108568004 | A | 9/2018 |
| CN | 207803967 | U | 9/2018 |
| CN | 207979464 | U | 10/2018 |
| CN | 208274341 | U | 12/2018 |
| CN | 109171384 | A | 1/2019 |
| CN | 208491592 | U | 2/2019 |
| CN | 208837517 | U | 5/2019 |
| CN | 208909669 | U | 5/2019 |
| CN | 208909781 | U | 5/2019 |
| CN | 209074020 | U | 7/2019 |
| CN | 209152976 | U | 7/2019 |
| CN | 209152977 | U | 7/2019 |
| CN | 209290950 | U | 8/2019 |
| CN | 209601321 | U | 11/2019 |
| CN | 209628950 | U | 11/2019 |
| CN | 209629322 | U | 11/2019 |
| CN | 209694787 | U | 11/2019 |
| CN | 110522149 | A | 12/2019 |
| CN | 110613615 | A | 12/2019 |
| CN | 209769933 | U | 12/2019 |
| CN | 209826151 | U | 12/2019 |
| CN | 209826154 | U | 12/2019 |
| CN | 209826161 | U | 12/2019 |
| CN | 110638654 | A | 1/2020 |
| CN | 209883708 | U | 1/2020 |
| CN | 209965566 | U | 1/2020 |
| CN | 209983942 | U | 1/2020 |
| CN | 210185316 | U | 3/2020 |
| CN | 210204319 | U | 3/2020 |
| CN | 210338700 | U | 4/2020 |
| CN | 210471953 | U | 5/2020 |
| CN | 210493691 | U | 5/2020 |
| CN | 210539606 | U | 5/2020 |
| CN | 111297146 | A | 6/2020 |
| CN | 210642901 | U | 6/2020 |
| CN | 210672945 | U | 6/2020 |
| CN | 210762226 | U | 6/2020 |
| CN | 210783325 | U | 6/2020 |
| CN | 210810370 | U | 6/2020 |
| CN | 210913566 | U | 7/2020 |
| CN | 210988757 | U | 7/2020 |
| CN | 210989514 | U | 7/2020 |
| CN | 211227783 | U | 8/2020 |
| CN | 211269072 | U | 8/2020 |
| CN | 211301425 | U | 8/2020 |
| CN | 211340130 | U | 8/2020 |
| CN | 211582524 | U | 9/2020 |
| CN | 111732140 | A | 10/2020 |
| CN | 211724056 | U | 10/2020 |
| CN | 211862065 | U | 11/2020 |
| CN | 211933823 | U | 11/2020 |
| CN | 211934935 | U | 11/2020 |
| CN | 212038304 | U | 12/2020 |
| CN | 212066390 | U | 12/2020 |
| CN | 212139718 | U | 12/2020 |
| CN | 212307476 | U | 1/2021 |

(56) References Cited

FOREIGN PATENT DOCUMENTS

| | | | |
|---|---|---|---|
| CN | 212328738 | U | 1/2021 |
| CN | 212489443 | U | 2/2021 |
| CN | 212501560 | U | 2/2021 |
| CN | 212532339 | U | 2/2021 |
| CN | 212815702 | U | 3/2021 |
| CN | 212972671 | U | 4/2021 |
| CN | 213883293 | U | 8/2021 |
| DE | 2042593 | | 3/1972 |
| EP | 3443874 | A1 | 2/2019 |
| KR | 2020120002446 | | 4/2012 |
| WO | 2004110878 | | 12/2004 |
| WO | WO 2016/046576 | A1 | 3/2016 |

OTHER PUBLICATIONS

PCT International Preliminary Report on Patentability regarding PCT/US2022/044510 dated Apr. 11, 2024, 12 pages.

* cited by examiner

CONTAINERS

RELATED APPLICATIONS

This application claims priority to U.S. Provisional Application No. 63/248,926, filed on Sep. 27, 2021, the entirety of which is hereby incorporated by reference.

TECHNICAL FIELD

This disclosure relates to collapsible containers, and particularly those containers' structure, material, and manufacturing.

BACKGROUND

Many current containers on the market are not collapsible, and therefore, a user cannot adjust their capacity according to the user's demands. Further, even if a container is collapsible, the collapsible assembly may be unstable for a user to easily adjust the capacity of the container.

SUMMARY

This summary is a brief description of certain aspects of this disclosure. It is not intended to limit the scope of this disclosure.

One exemplary embodiment of this invention provides a container, including: a collapsible portion and a container base. The collapsible portion has a first step structure; a second step structure; and a hinge assembly coupled between the first step structure and the second step structure. The container base is coupled to the collapsible portion.

Another exemplary embodiment of this invention provides a container, including: a container base; a collapsible portion, coupled to the container base; a lid base, coupled to the collapsible portion; a ring, coupled to the lid base and sandwiching a periphery of the collapsible portion with the lid base; and a lid assembly, coupled to the ring when the container is in a closed status.

Still another exemplary embodiment of this invention provides a container, including a collapsible portion and a container base. The collapsible portion has a first collapsible unit and a second collapsible unit, each having: an annular inner wall; an annular outer wall; and an annular link, coupled between the inner wall and the outer wall, wherein the inner wall is received by a space enclosed by the outer wall when the collapsible portion is collapsed. The container base is coupled to the collapsible portion.

The above and other aspects and their implementations are described in greater detail in the drawings, the descriptions, and the claims.

BRIEF DESCRIPTION OF THE DRAWINGS

The embodiments can be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1A:
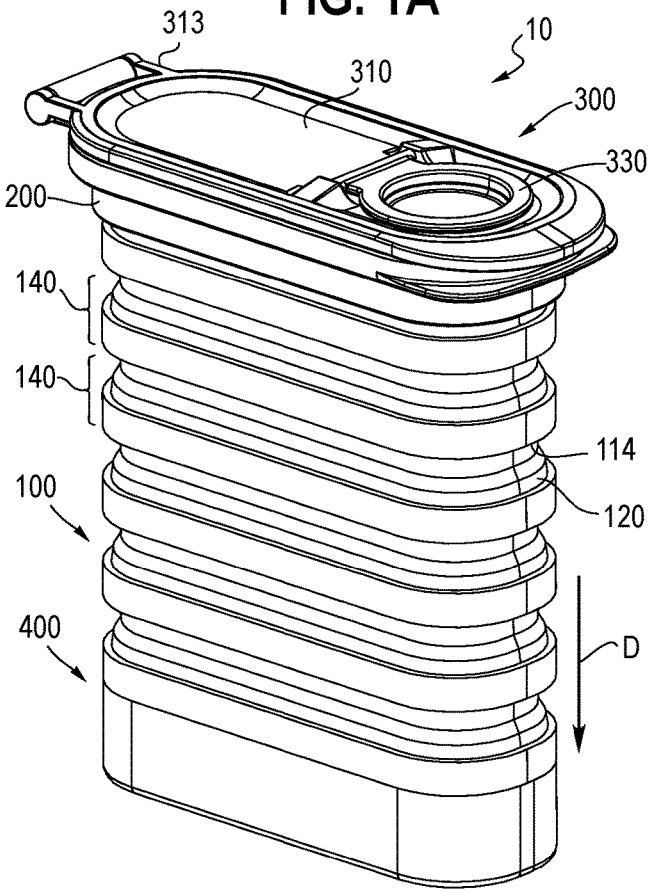
FIG. 1A is a perspective view of a container according to one embodiment of this disclosure.

FIGS. 1A-G, 2A-G, and 3A-E show an embodiment of a container of this disclosure. The container 10 includes a collapsible portion 100 and a container base 400. The container base 400 can be uncompressible. The container 10 may further include a lid base 200 coupled to the collapsible portion 100 and a lid assembly 300 coupled to the lid base 200. The lid base 200 can be mounted on the collapsible portion 100, and the lid base 200 can receive the lid assembly 300, so as to close the container 10 in a closed status.

Figure 3A:
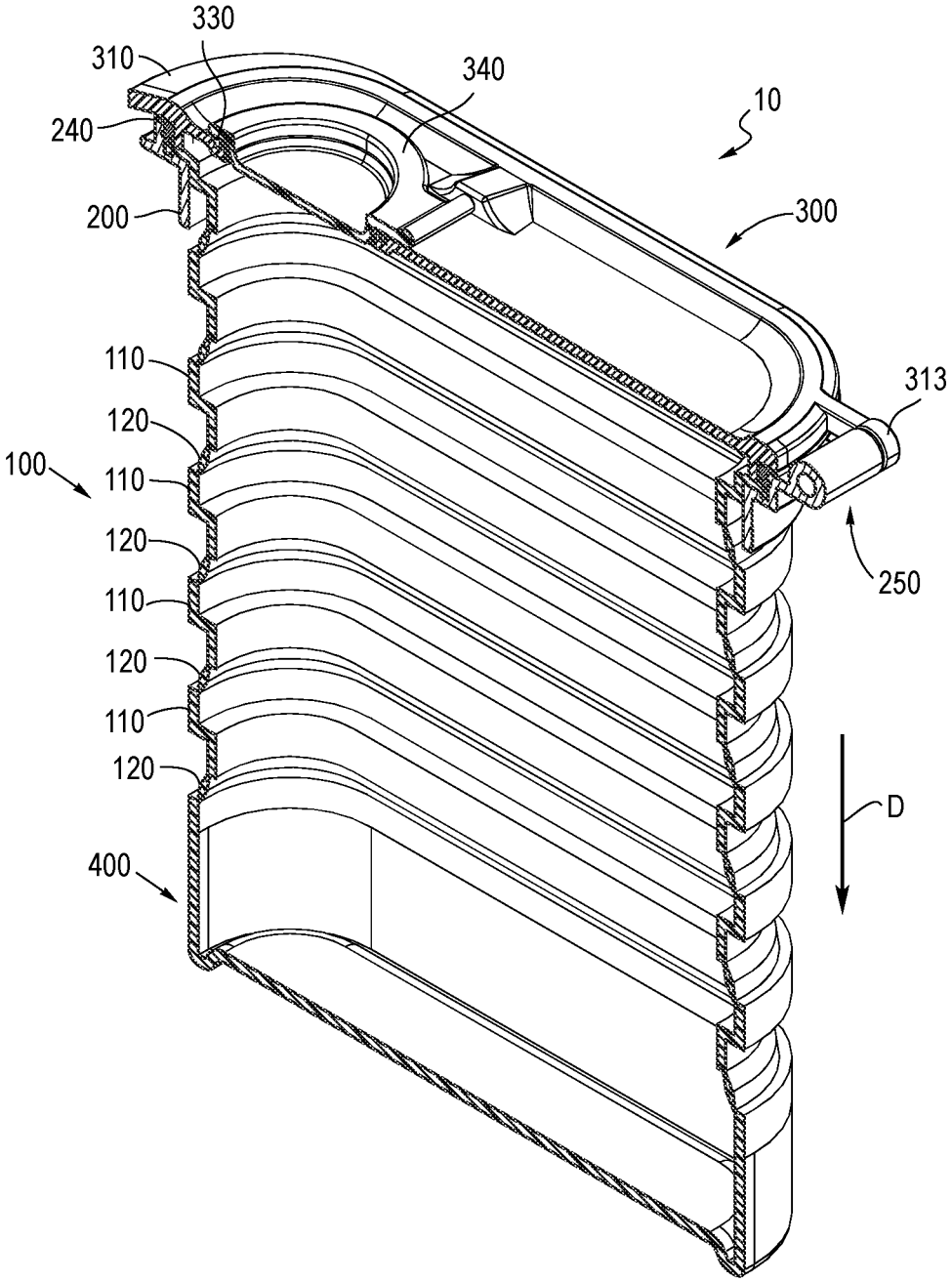
FIG. 3A shows a cross-sectional view of the container of FIG. 1A.
Figure 3B:
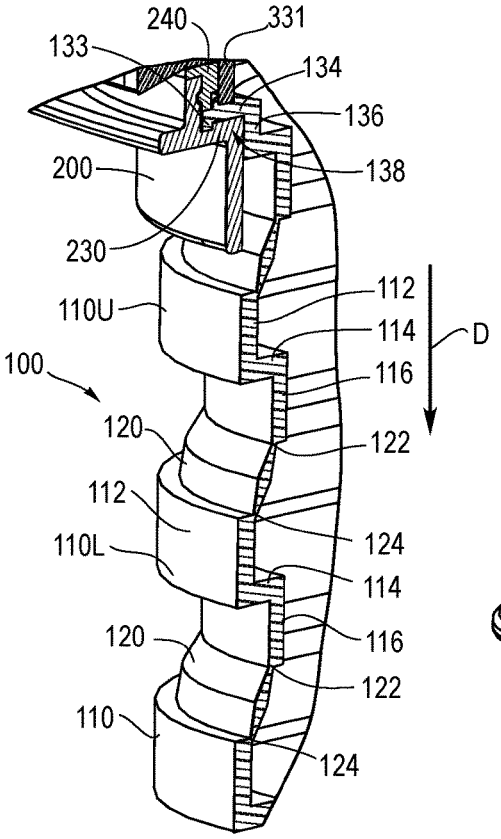
FIGS. 3B-D show partial enlarged cross-sectional views of the container of FIG. 1A.

FIG. 3B shows a partial cross-sectional view of the collapsible portion 100, and a complete cross-sectional view of the container 10 is shown in FIG. 3A. The collapsible portion 100 may include multiple step structures 110. The multiple step structures 110 can be annular. Using two step structures 110 as an example, a hinge assembly, including an intermediate structure 120, is coupled between an upper step structures 110U and a lower step structure 110L at a first end of the intermediate structure 120 and a second end of the intermediate structure 120 opposite to the first end. The intermediate structure 120 can be annular and contoured with an end of the step structures 110. The intermediate structure 120 may be angled relative to the upper and lower steps structures 110. The connection at the first end of the intermediate structure 120 forms a first hinge 122 (such as a living hinge), the connection at the second end of the intermediate structure 120 forms a second hinge 124 (such as a living hinge). Therefore, the intermediate structure 120 can pivot about the first hinge 122 and the second hinge 124 relative to the upper step structure 110U and the lower step structure 110L.

Further, intermediate structure 120 may have a greatest thickness at the middle of the intermediate structure 120 and have a smallest thickness at the first end and the second end of the intermediate structure 120, that is, the locations of the first hinge 122 and second hinge 124. The thickness from the first end and second end to the middle of the intermediate structure 120 can change gradually. As shown in FIG. 3B, a cross-section of the intermediate structure 120 can be a diamond shape. As shown in FIG. 3A, the collapsible portion 100 include a plurality of step structures 110 and intermediate structures 120 alternately connected to each other. The number of the step structures 110 and the intermediate structures 120 may vary according to different demands on the capacity of the container 10. For example, a container can have only two step structures interconnected with an intermediate portion 120. A container can also have more than two step structures and more intermediate portions 120.

As shown in FIG. 3B, each step structure 110 may include an upper sidewall 112, a transverse step 114, and a lower sidewall 116. The transverse step 114 is connected to the upper sidewall 112 and the lower sidewall at two opposite ends. The transverse step 114 can be perpendicular to the upper sidewall 112 and/or the lower sidewall 116. The transverse step 114 spaces the upper side wall 112 and the lower sidewall 116 apart along a direction perpendicular to a depth axis D of the container 10. The upper sidewall 112 and the lower sidewall 116 may be parallel to each other, and the height of the upper sidewall 112 and the lower sidewall 116 may be identical or different. A downward projection (along the depth axis D of the container 10) of the lower sidewall 116 of the upper step structure 110U is on the transverse step 114 of the lower step structure 110L. An upward projection along the depth axis D of the container 10 of the upper sidewall 112 of the lower step structure 110L is on the transverse step 114 of the upper step structure 110U, as indicated by the dashed lines in FIG. 3A. Further, the plurality of upper sidewalls 112 are aligned with each other, and the plurality of lower sidewalls 116 are aligned with each other. Further, the downward projections of the lower sidewalls 116 are positioned inward of the upward projections of the upper sidewalls 112. The intermediate structure 120 is connected at an exterior surface of the lower sidewall 116 of the upper step structure 110U, and the intermediate structure 120 is connected to an interior surface of the upper side wall of the lower step structure 110L.

Figure 3C:
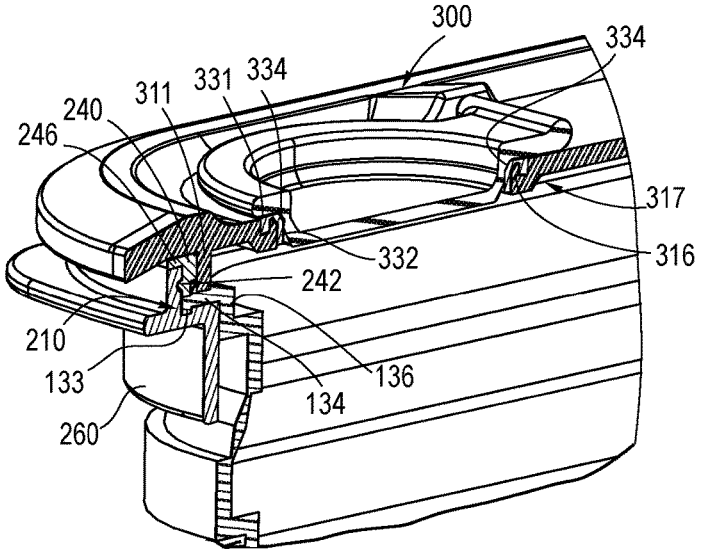
Figure 3D:
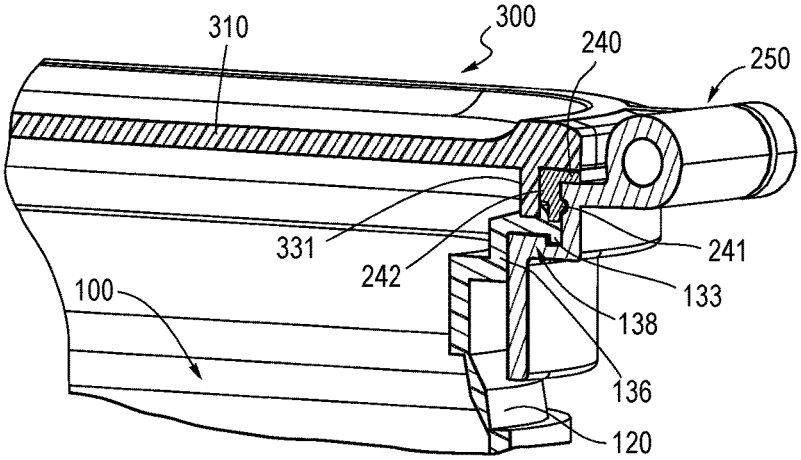
Figure 3E:
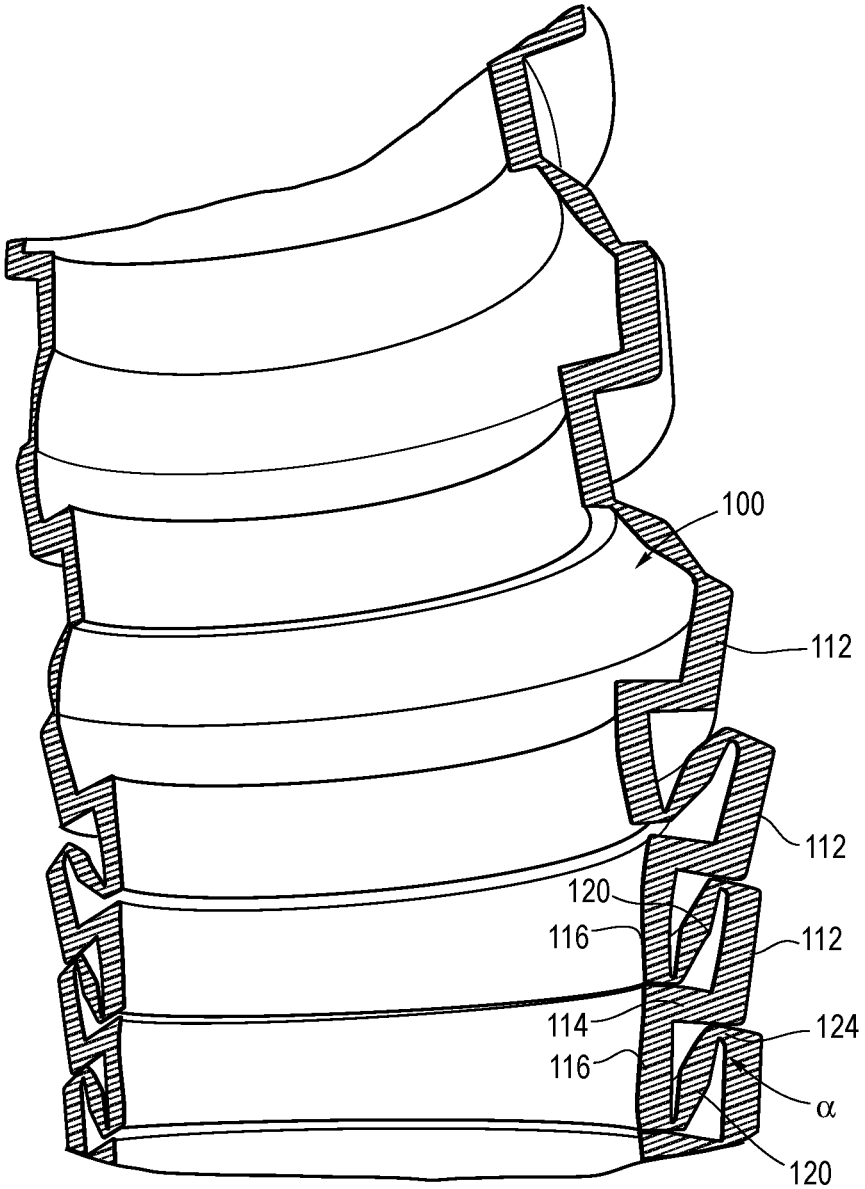
FIG. 3E shows an illustrative cross-sectional view of the collapsible portion of the container of FIG. 1A.

As shown in FIG. 3E, when the collapsible portion 100 is in a collapsed status after the upper step structure 110U moves toward the lower step structure 110L, the transverse step 114 of the lower step structure 110L supports the lower sidewall 116 of the upper step structure 110U; the transverse step 114 of the lower step structure 110L may be in contact with the lower sidewall 116 of the upper step structure 110U. Likewise, when the collapsible portion 100 is in the collapsed status after the upper step structure 110U moves toward the lower step structure 110L, the upper sidewall 112 of the lower step structure 110L supports the transverse step 114 of the upper step structure 110U; the upper sidewall 112 of the lower step structure 110L may be in contact with the transverse step 114 of the upper step structure 110U. In another implementation, the hinge 124 between the lower step structure 110L and the intermediate structure 120 may support and/or be in contact with the transverse step 114 of the upper step structure 110U, as shown in FIG. 3E. Further, the hinge 122 between the intermediate structure 120 and the upper step structure 110U may be supported by and/or in contact with the transverse step 114 of the lower step structure 110L. The transverse steps 114 may be dimensioned to accommodate the thickness of the upper sidewalls 112, the lower side walls 116, and the sandwiched intermediate structures 120, such that there is enough space to house the intermediate structures 120 and to support the upper sidewalls 112 and/or the lower sidewalls 116. When the container 10 is in a collapsed status, an angle $\alpha$ (as shown in FIG. 3E) between the intermediate structure 120 and the sidewalls 112, 116 is about 5-10 degrees, 10-15, 15-20 degrees, 20-25 degrees, and 25-30 degrees.

When a force is applied on the collapsible portion 100 to turn the container 10 from an extended status to the collapsed status, the different step structures 110 move toward each other. At the same time the intermediate structures 120 pivot about the corresponding hinges 122 and hinges 124 relatively to the upper and lower step structures 110. The intermediate structure 120 rotates approximately 90 degrees when the collapsible portion 100 is move from an extended status to a collapsed status. When the collapsible portion 100 is in a collapsed status, the lower sidewall 116 of the upper step structure 110U sandwiches the intermediate structure 120 with the upper sidewall 112 of the lower step structure 110L as shown in FIG. 3E.

Figure 3F:
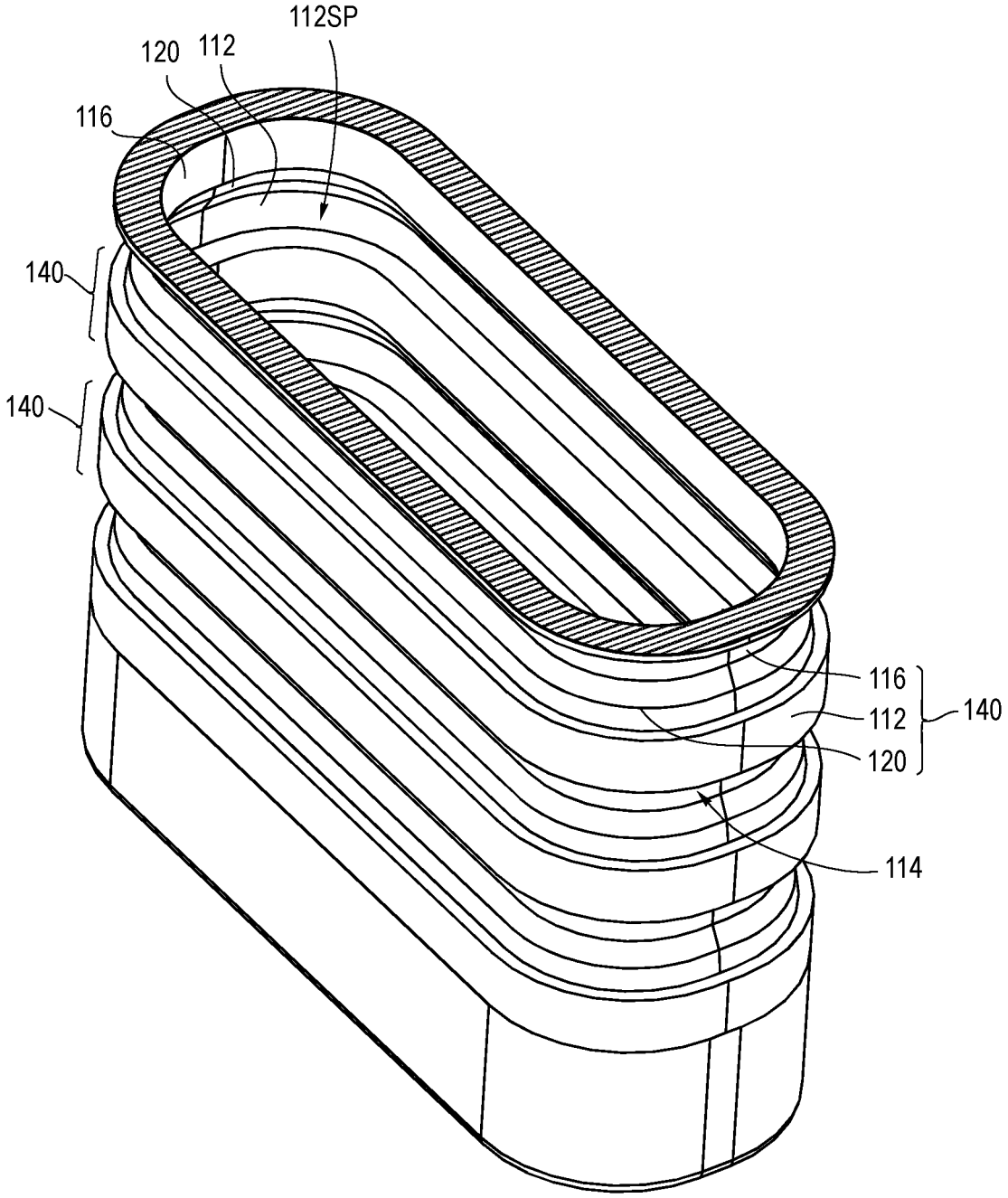
FIG. 3F is a horizontal cross-sectional view of the container of FIG. 1A.
Figure 4A:
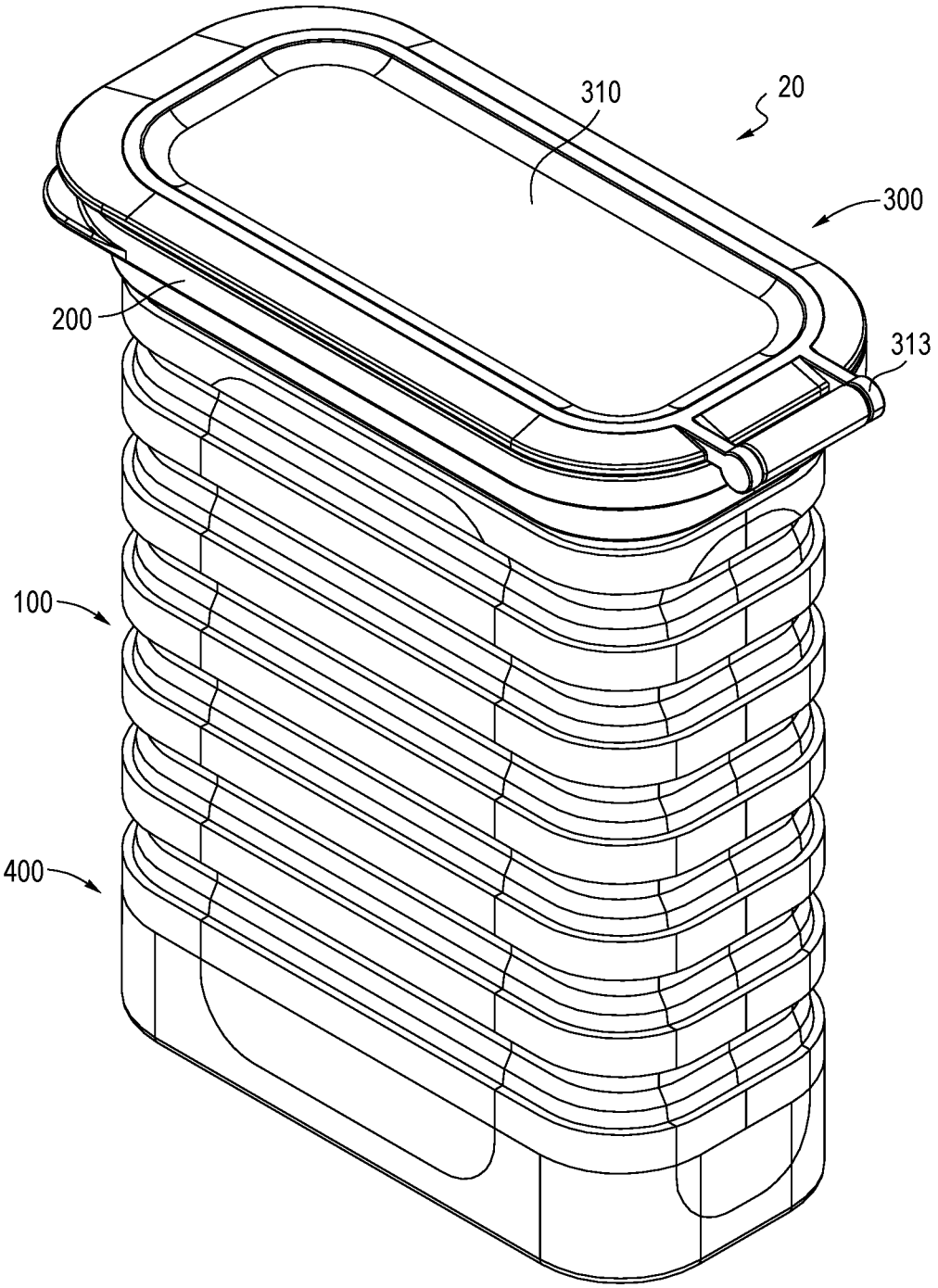
FIG. 4A is a perspective view of a container according to another embodiment of this disclosure.
Figure 4B:
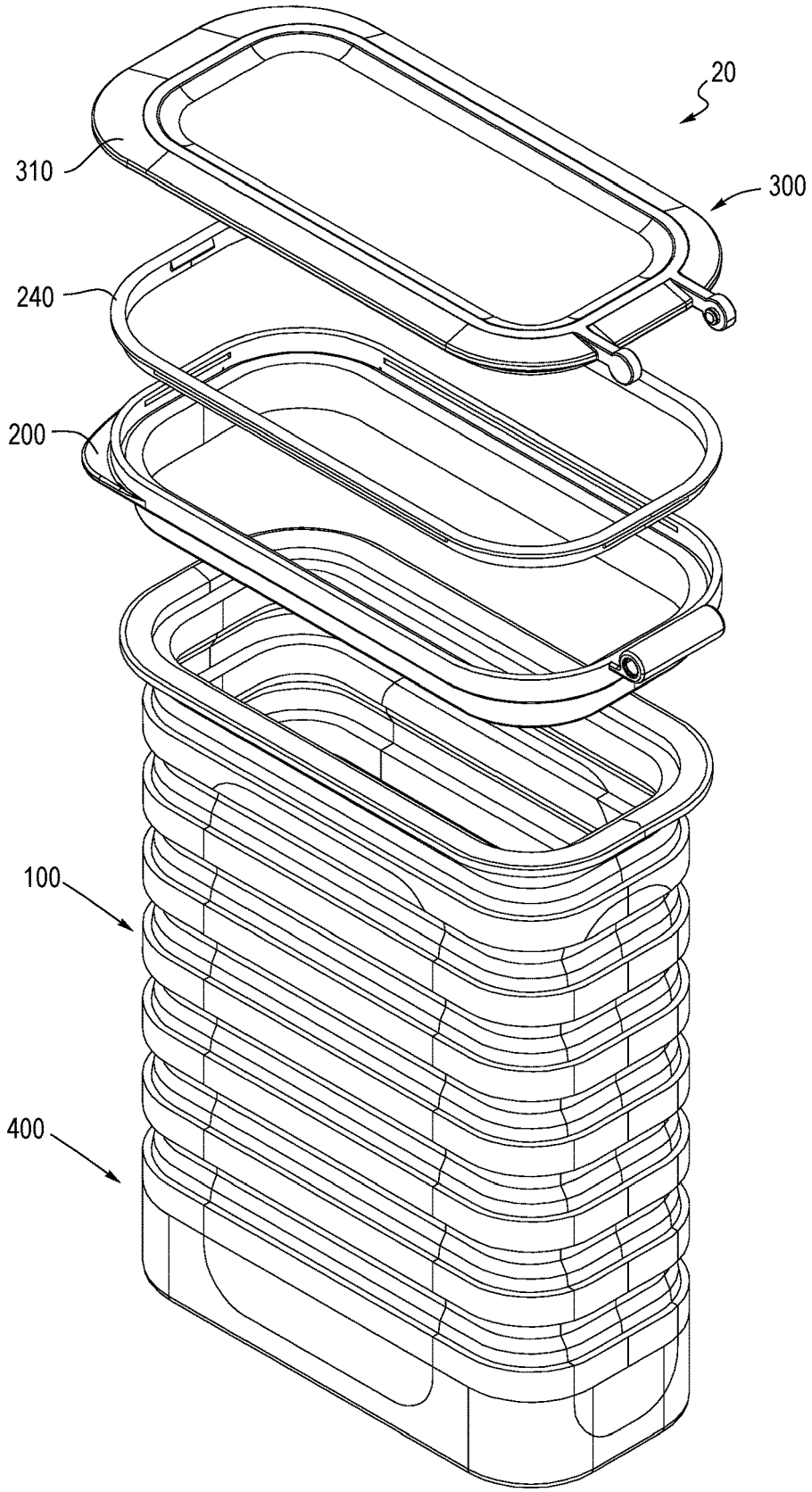
FIG. 4B is an exploded view of the container of FIG. 4A.
Figure 4C:
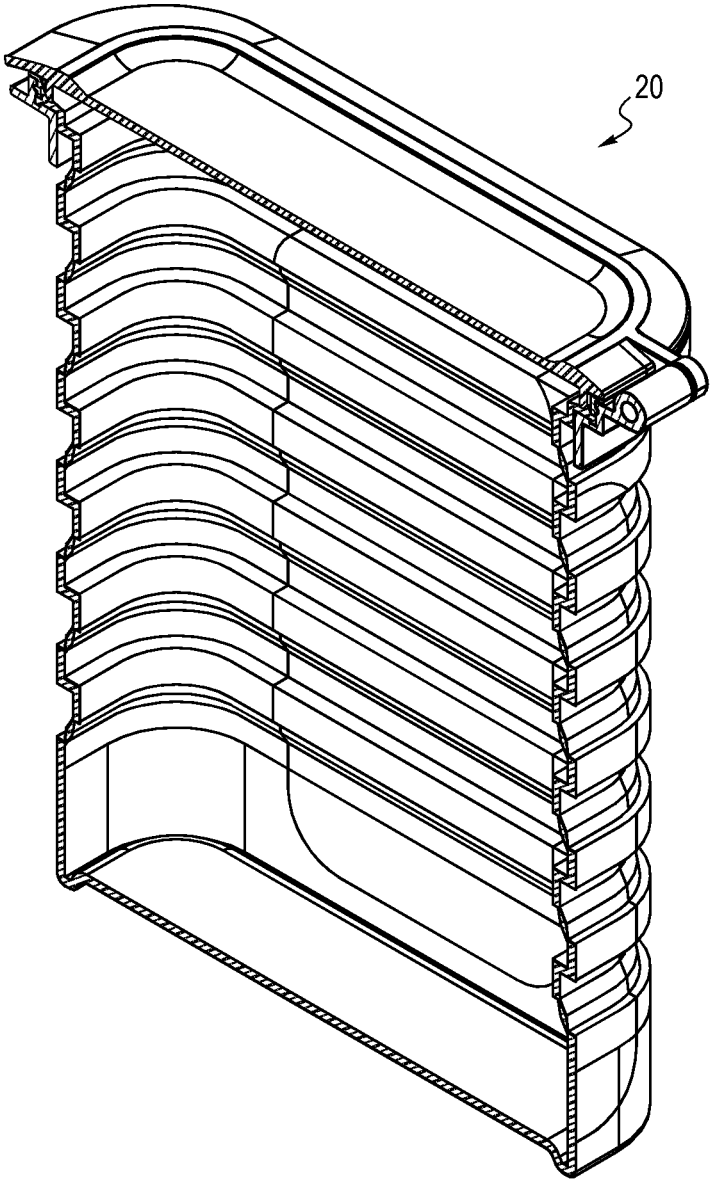
FIG. 4C is a cross-sectional view of the container of FIG. 4A.
Figure 4D:
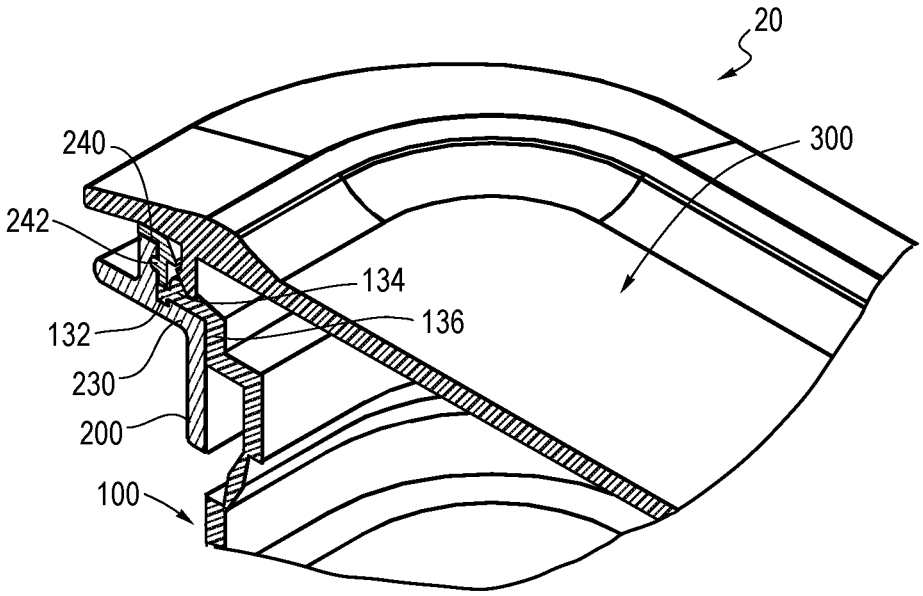
FIGS. 4D, E, F, and G are partial cross-sectional views of the container of FIG. 4A.
Figure 4E:
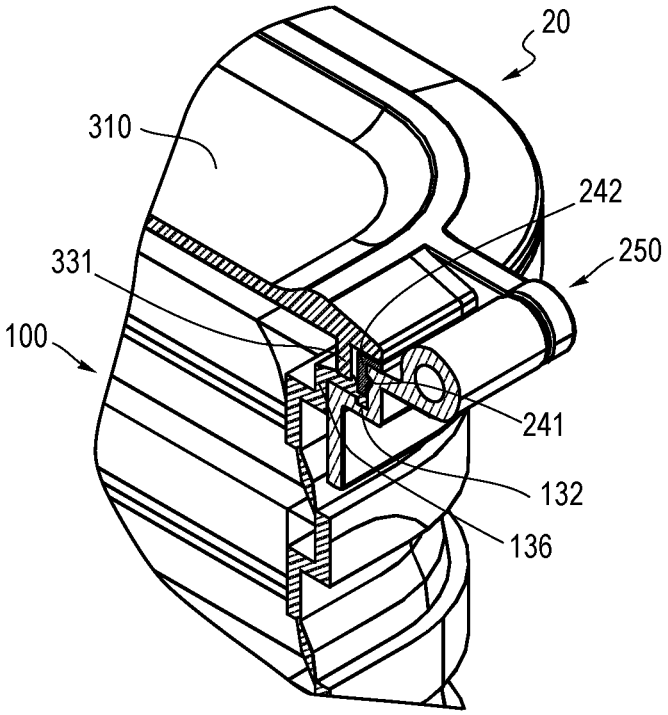
Figure 4F:
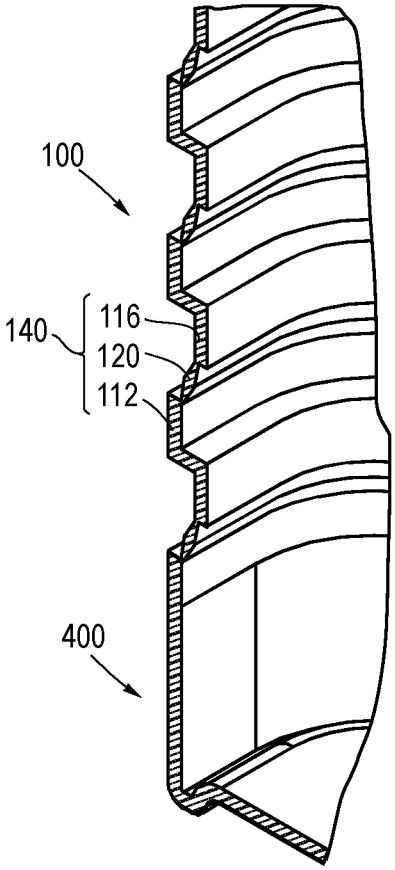
Figure 4G:
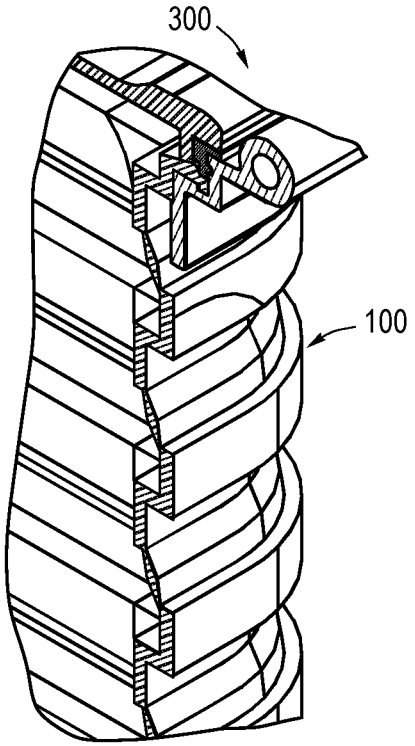
Figure 5A:
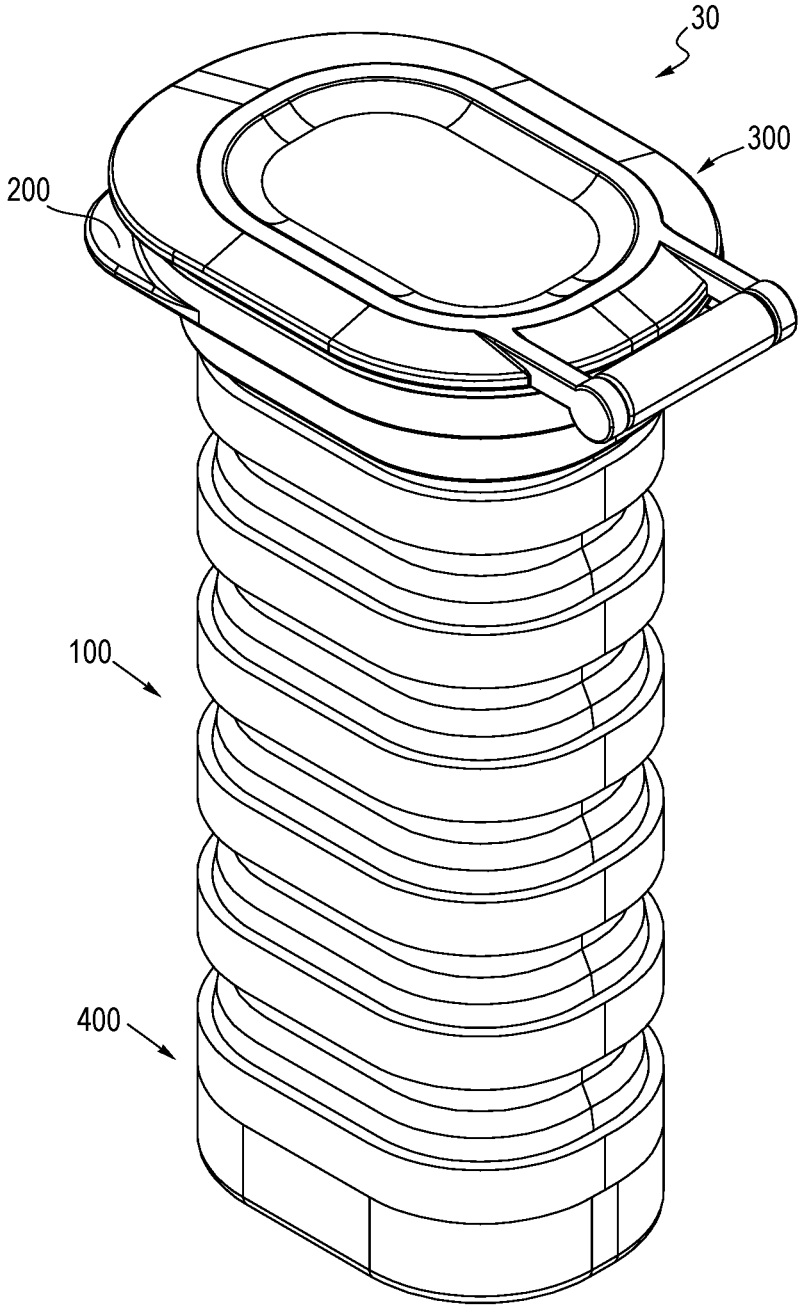
FIG. 5A is a perspective view of a container according to another embodiment of this disclosure.
Figure 5B:
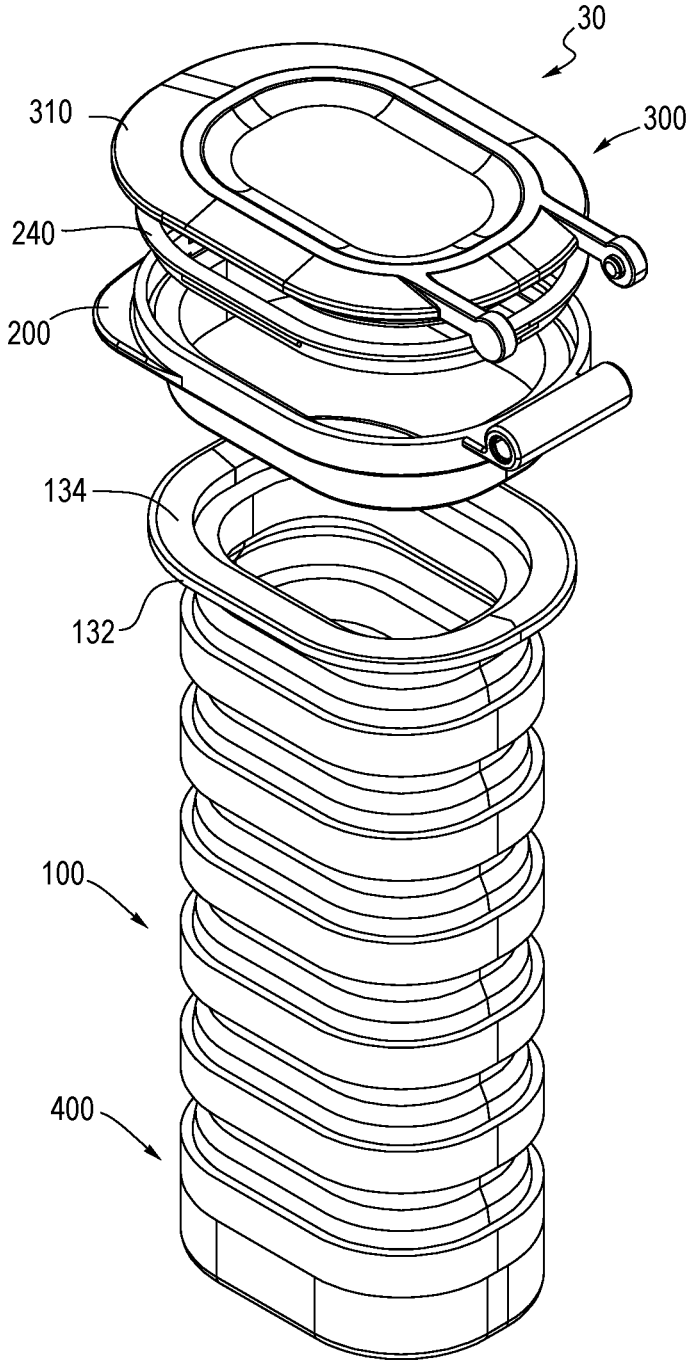
FIG. 5B is an exploded view of the container of FIG. 5A.
Figure 5C:
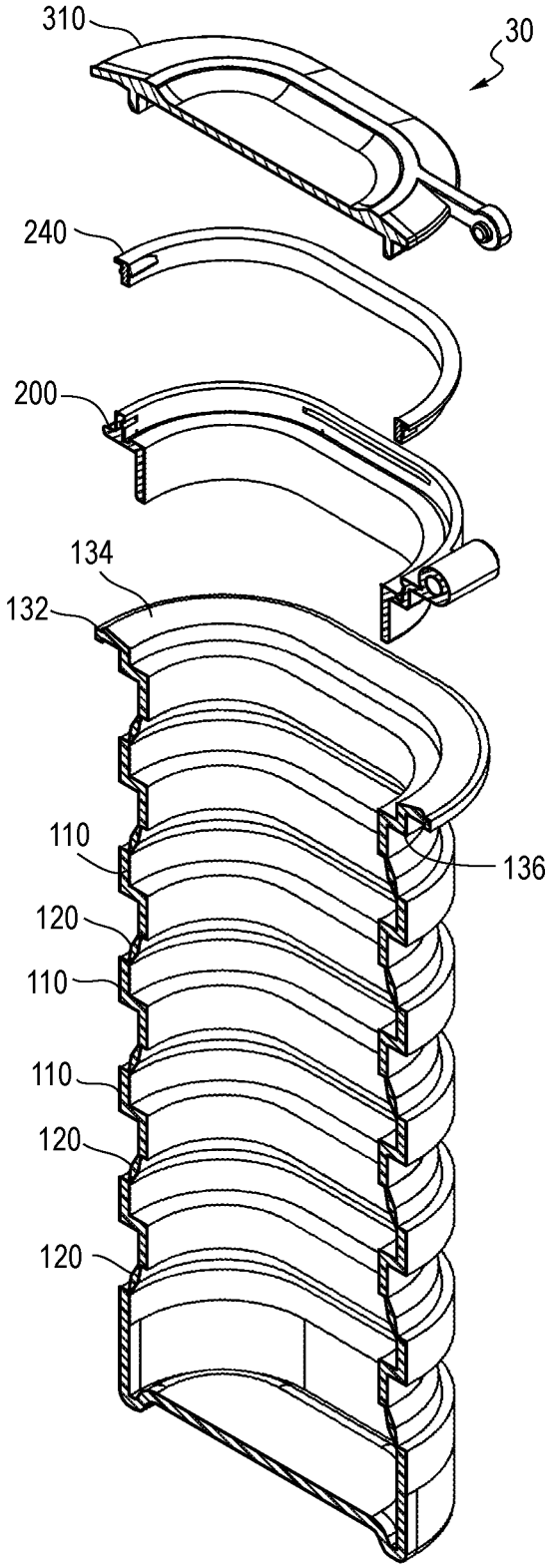
FIG. 5C is an exploded cross-sectional view of the container of FIG. 5A.
Figure 5D:
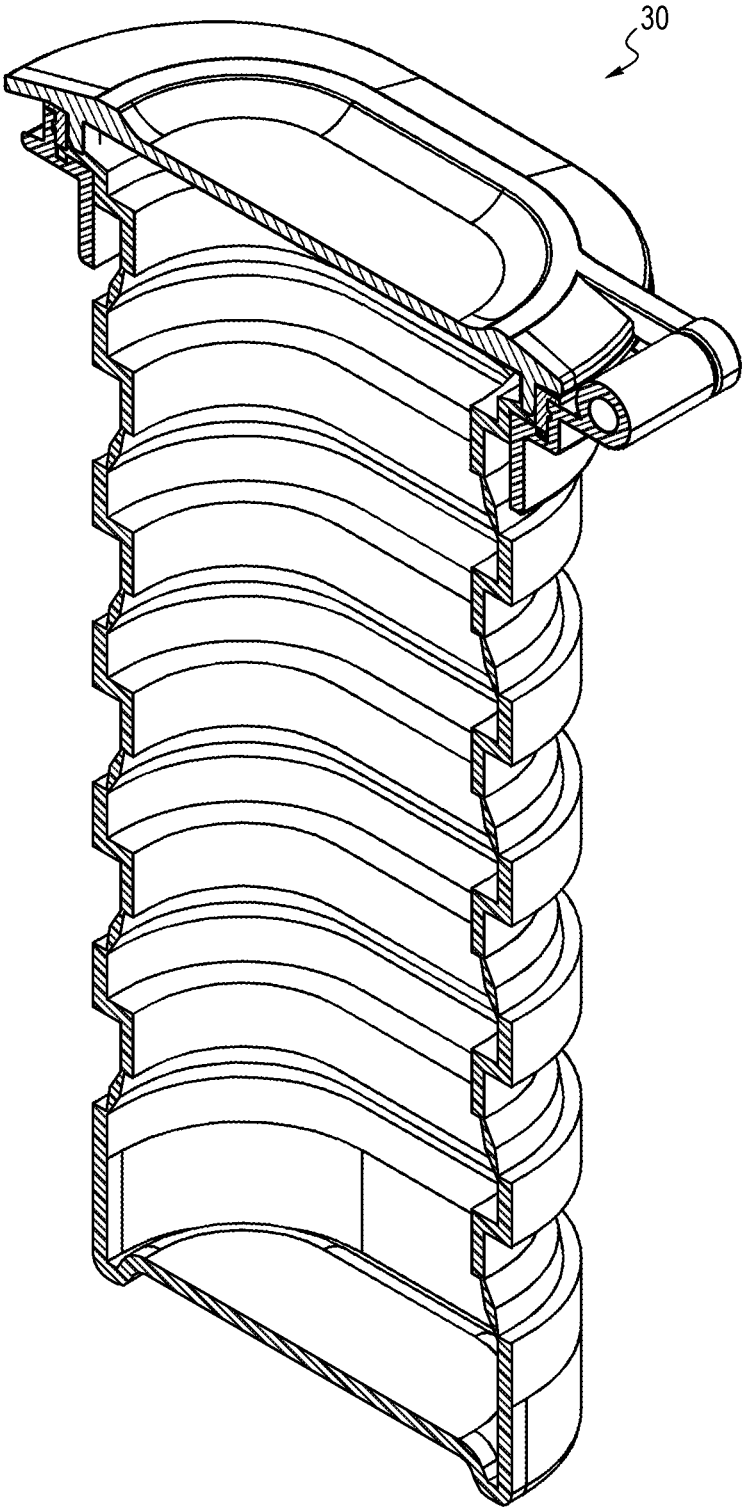
FIG. 5D is a cross-sectional view of the container of FIG. 5A.
Figure 5E:
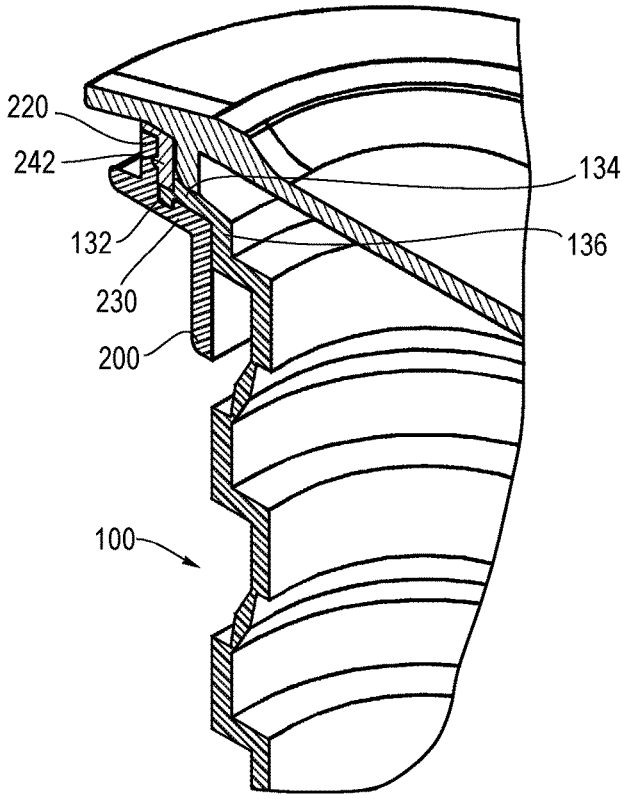
FIGS. 5E and 5F are partial cross-sectional views of the container of FIG. 5A.
Figure 5F:
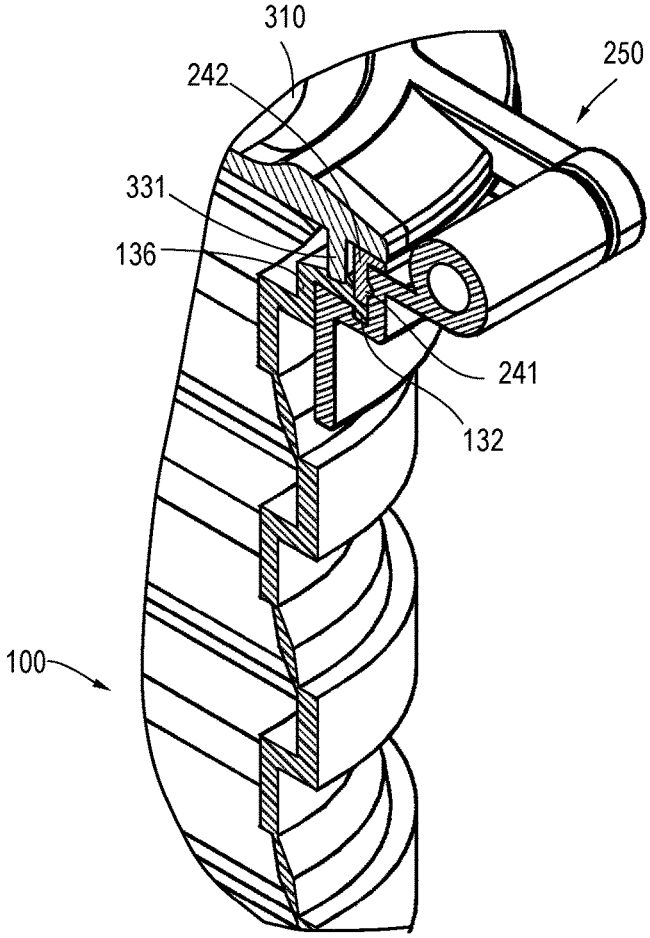

In other words, the container 10 includes a collapsible portion 100, having a first collapsible unit 140 (as shown in FIGS. 1A and 3F) and a second collapsible unit 140 adjacent to each other. Each collapsible unit 140 includes an annular inner wall, such as the wall 116, an annular outer wall, such as the wall 112, and an annular link, such as the intermediate structure 120. The annular link 120 is coupled between the inner wall 116 and the outer wall 112. The inner 116 wall is received by the space 112SP enclosed by the outer wall 112 when the collapsible portion 100 is collapsed as shown in FIGS. 3E and 3F, so as to lower the height of the container. A transverse step 114 is coupled between the first and second collapsible units 140. That is, one transverse step 114 is coupled between the outer wall 112 of the first collapsible unit 140 and the inner wall 116 of the adjacent second collapsible unit 140.

Figure 1B:
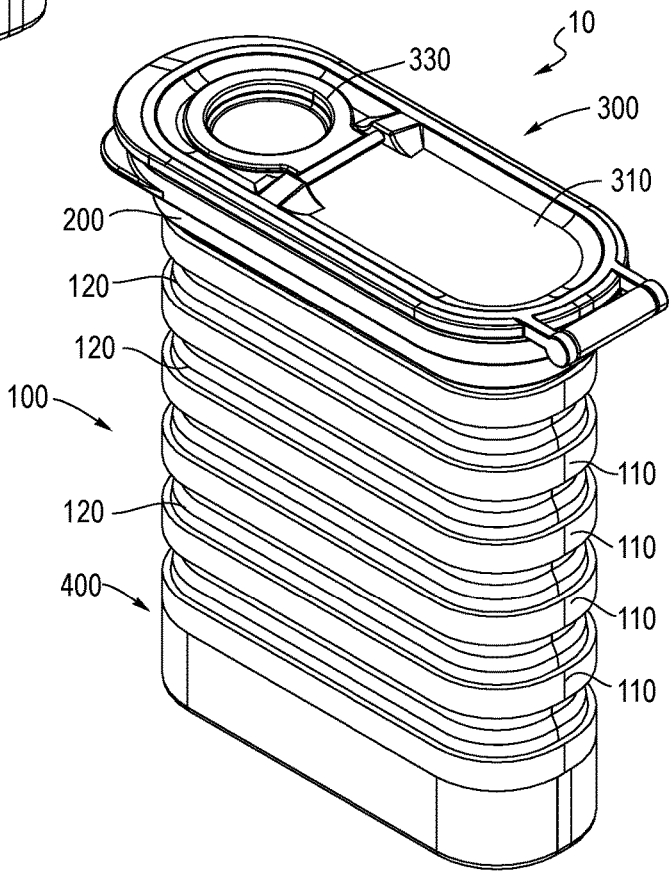
FIG. 1B is another perspective view of the container of FIG. 1A from another view angle.
Figure 1C:
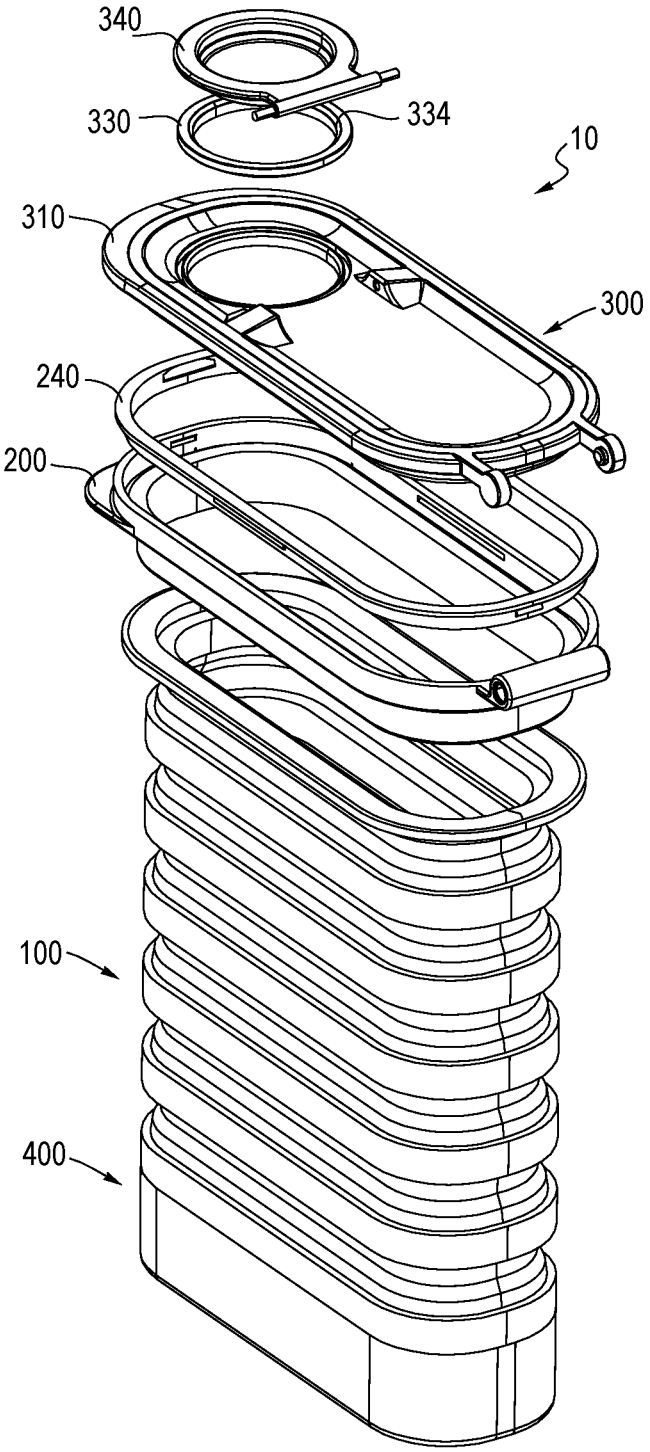
FIG. 1C is an exploded view of the container of FIG. 1A.
Figure 1D:
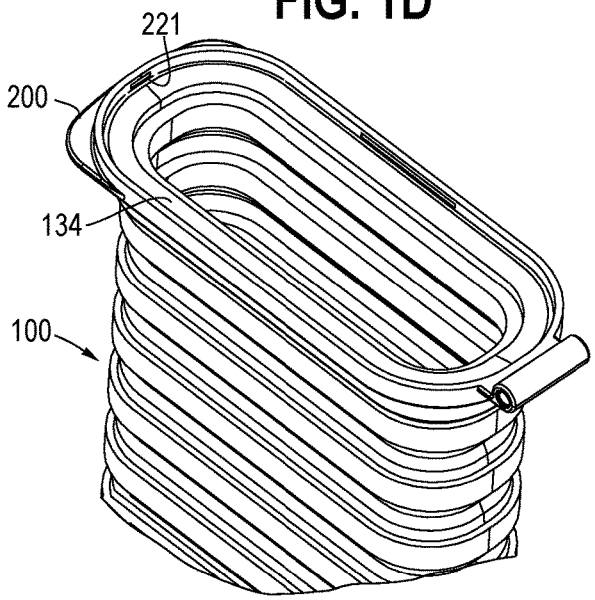
FIG. 1D is a partial enlarged view of the container of FIG. 1A after the lid is removed.
Figure 1E:
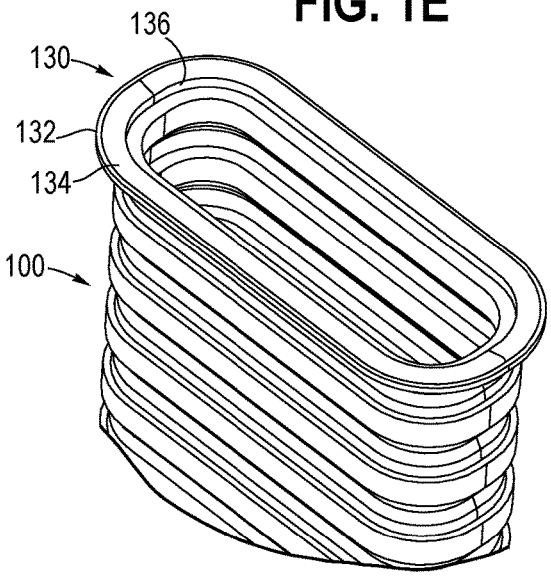
FIG. 1E is a partial enlarged view of the container of FIG. 1A after the lid base is removed.
Figure 1F:
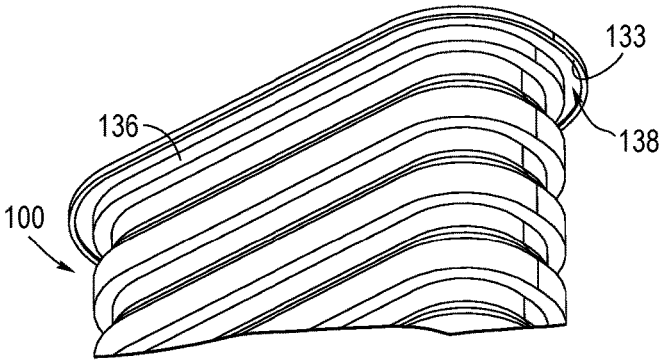
FIG. 1F is a partial enlarged view of the container of FIG. 1A after the lid base is removed from another view point.

As shown in FIGS. 1D, E, and F, the collapsible portion 100 may have an annular protrusion 130 extending radially outward from an opening of the collapsible portion 100. The annular protrusion 130 may be of a unitary construction with the step structures 110 and the intermediate structures 120. The protrusion 130 may include an annular periphery 132 and an annular gasket 134. The periphery 132 of the protrusion 130 surrounds the gasket 134. The thickness of the gasket 134 may be greater than the thickness of the periphery 132, as shown in FIGS. 3B to 3D. The thickness of the gasket 134 may decrease along an inward direction. As shown in FIG. 1F, the periphery 132 includes an annular lip 133 extending downwardly. At the inner edge of the gasket 134, opposite to the periphery 130, the collapsible portion 100 includes an inner wall 136 (as shown in FIG. 3B). The inner wall 136 may be annular and may extend downwardly from the inner edge of the gasket 134.

Figure 2A:
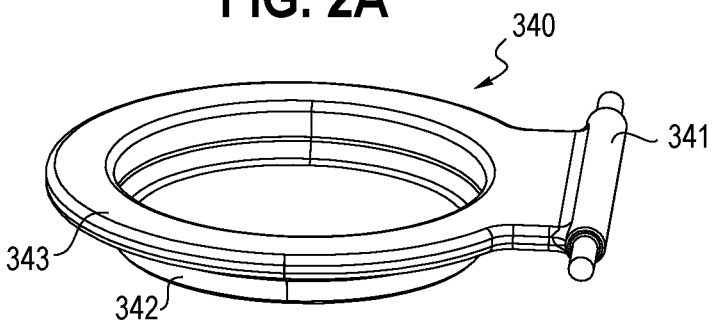
FIGS. 2A-G show the components of the container of FIG. 1A separately.
Figure 2B:
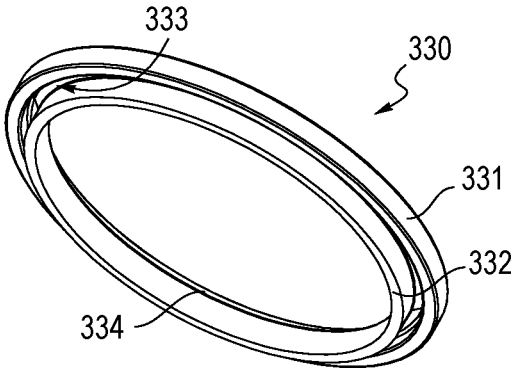
Figure 2C:
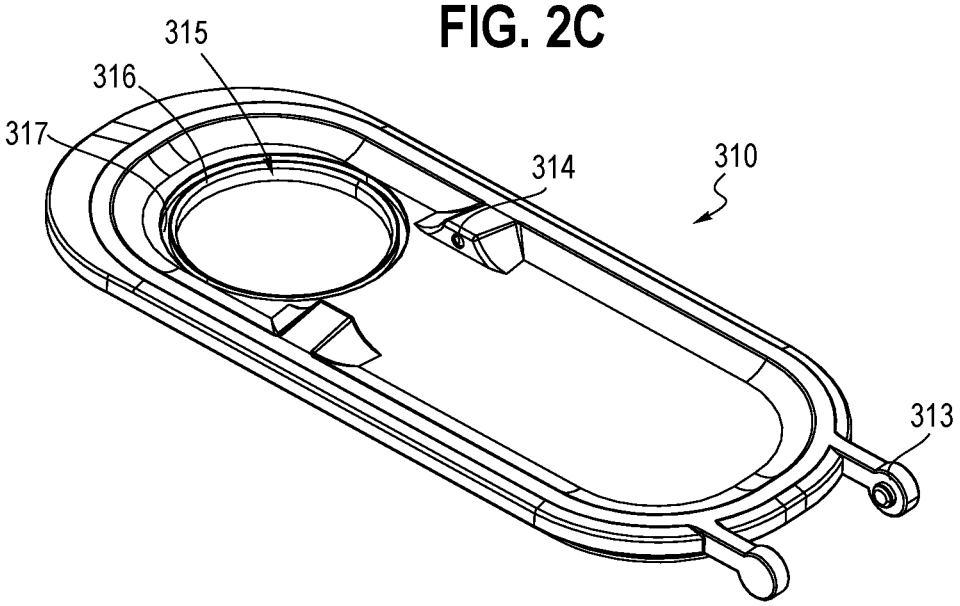
Figure 2D:
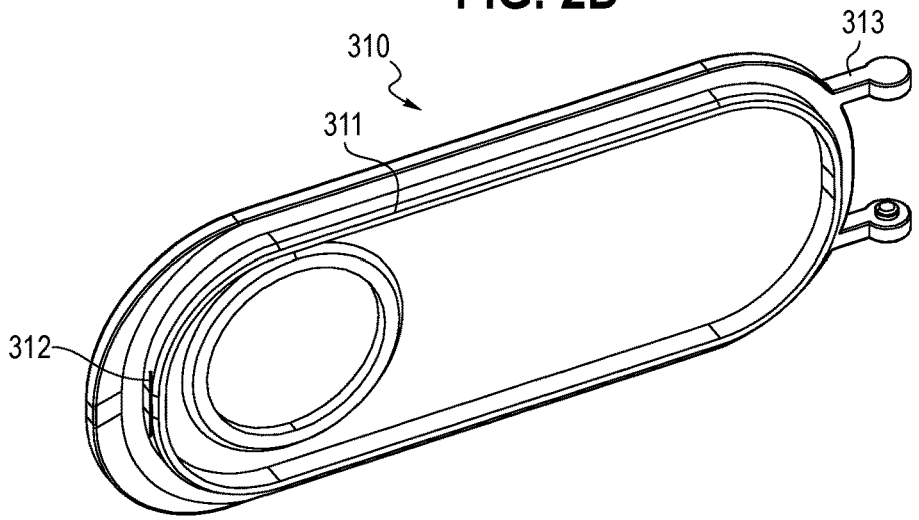
Figure 2E:
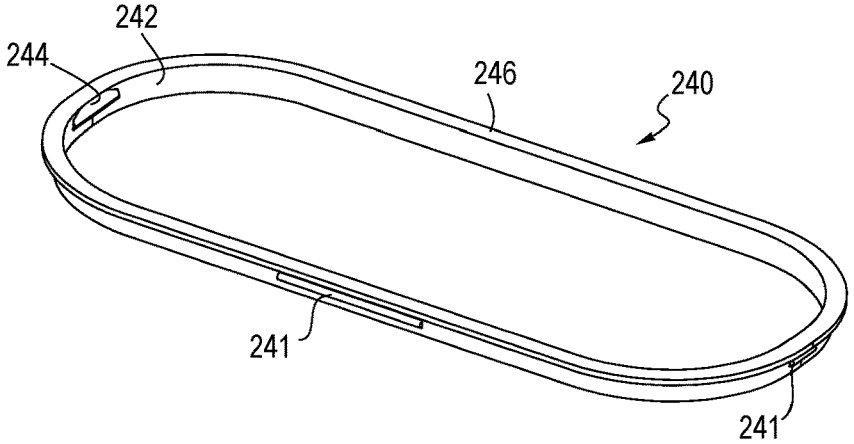
Figure 2F:
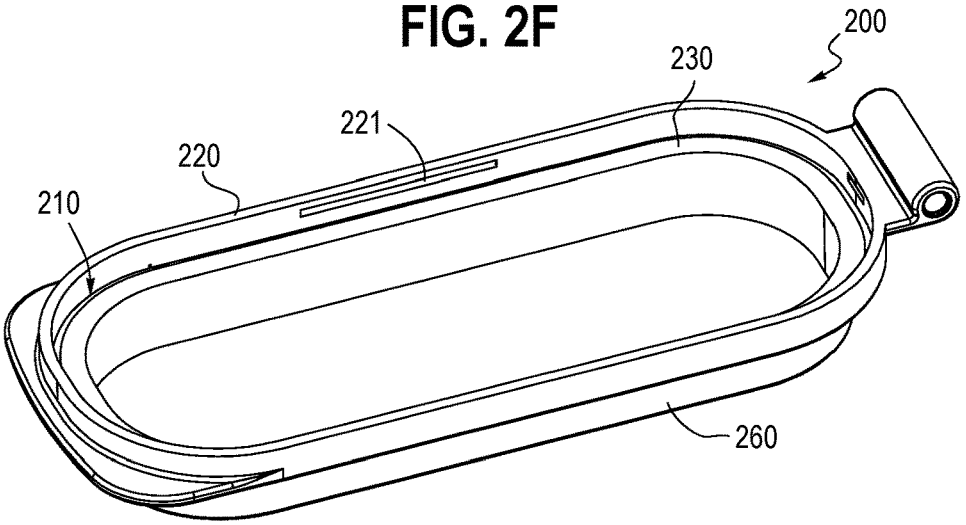
Figure 2G:
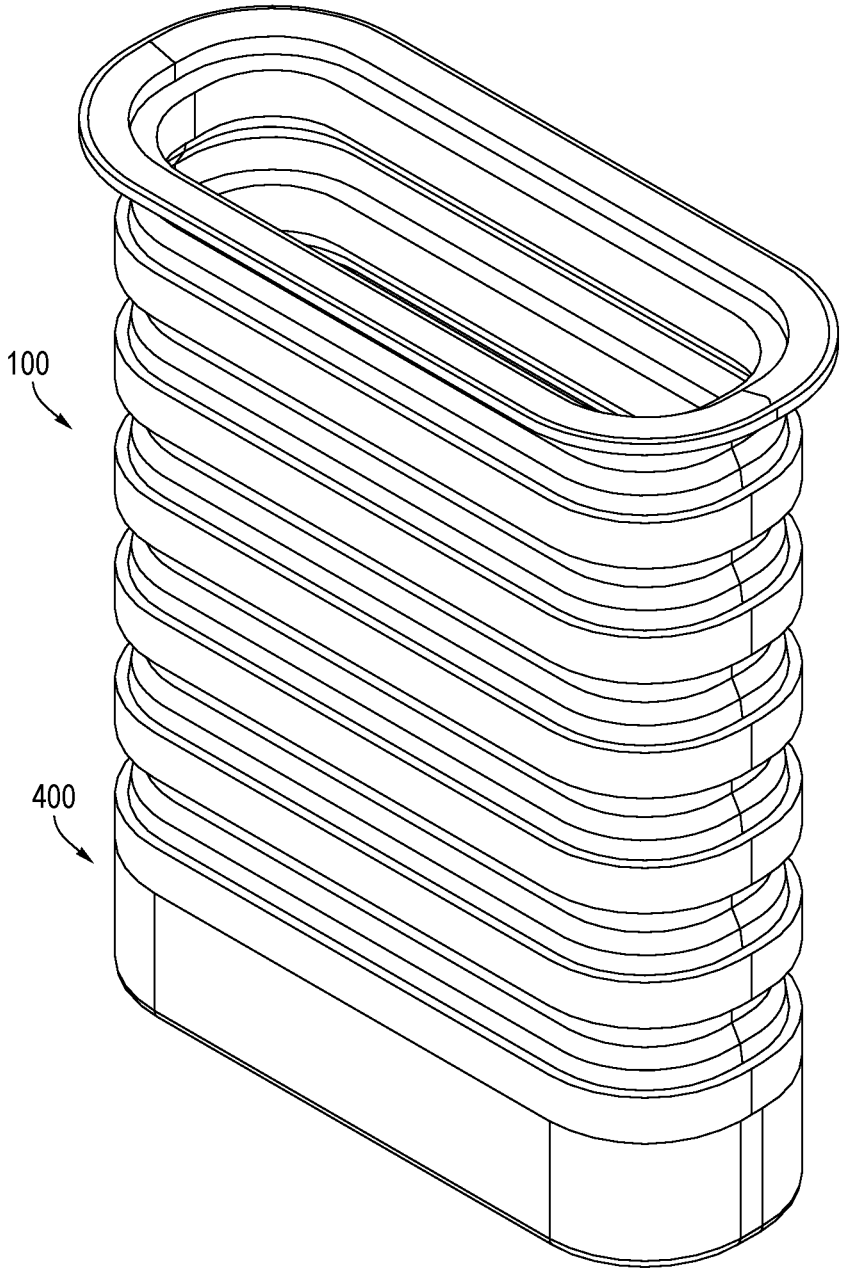

As shown in FIG. 2F, the lid base 200 has an annular channel 210 surrounded by an outer wall 220. The lid base 200 may further include an inner wall 230. The inner wall 230 may be thicker than the outer wall 220, and the inner wall 230 may be lower than the outer wall 220. The lid base may further include a lower wall 260, the lower wall extends downwardly from a side opposite to the inner wall 230. The lower wall 260 surrounds at least an upper portion of the collapsible portion 100. The lower wall 260 is longer than the inner wall 230 and the outer wall 220, but the lower wall 260 is thinner than the inner wall 230. The outer wall 220 and the inner wall 230 define the annular channel 210. The channel 210 of the lid base 200 may be contoured with the annular lip 133 of the periphery 132 of the protrusion 130. The channel 210 receives the lip 133 of the protrusion 130 as shown in FIG. 3C. The periphery 132, the gasket 134, and the inner wall 136 of the collapsible portion 100 form a downward facing annular groove 138. The groove 138 may be contoured with the inner wall 230 of the lid base 200 and may receive the inner wall 230 of the base lid 200, as shown in FIG. 3B. At least a portion of the gasket 134 is positioned over the inner wall 230 of the base lid 200. The periphery 132 and the inner wall 136 sandwich the at least a portion of the inner wall 230.

Figure 1G:
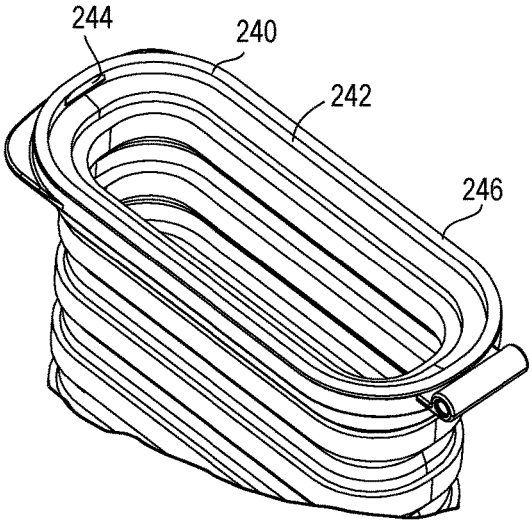
FIG. 1G is a partial perspective view of the container of FIG. 1A.

As shown in FIGS. 1G and 2E, the container 10 may further include a ring 240 mounted on the lid base 200, such as on the outer wall 220 of the lid base 200. The ring 240 may be contoured with the outer wall 220 of the lid base 200. The ring 240 may be mounted on the outer wall 220 with a snap fit structure. For example, the ring 240 may include a plurality of protrusions 241 (as shown in FIG. 2E). The protrusions 241 are configured on an annular lip 242 extending downwardly from the ring 240. The outer wall 220 of the lid base 200 has corresponding cuttings 221 (as shown in FIG. 2F). The ring 240 and the lid base 200 may be made of polypropylene, with a rigidity higher than the collapsible portion 100 and the container base 400. The cuttings 221 may receive corresponding protrusions 241 to form the snap fit feature. The protrusions 241 may be arranged evenly around the ring 240, and the cuttings 221 may be arranged evenly around the outer wall 220. In another implementation, the cuttings can be formed on the ring 240, and the protrusions can be form on the lid base 200. Further, the ring 240 has a transverse portion 246 coupled to the lip 242 and extending radially outward. The transverse portion 246 can be positioned over the outer wall 220 of the lid base 200.

As shown in FIG. 3C, after the ring 240 is mounted on the lid base 200, the lip 242 of the ring 240 extends downwardly and presses the annular periphery 132 of the collapsible portion 100 located in the annular channel 210 of the lid base 200. The lip 242 of the ring 240 may be contoured with the periphery 132 of the collapsible portion 100 and with the channel 210 of the lid base 200. As shown in FIG. 3C, a part of the lip 242 is located between the outer wall 220 of the lid base 200 and the gasket 134. The lip 242 sandwiches the periphery 132 of the collapsible portion 100 with the bottom of the channel 210. As shown in FIG. 2E, the ring 240 may further include a protrusion 244 configured to engage with a protrusion 312 of the lid 310 (as shown in FIG. 2D) to removably secure the lid 310 when the container 10 is in a closed status.

As shown in FIGS. 2C and 2D, the lid assembly 300 may include a first lid 310. The first lid 310 may include an annular lip 311 extending downwardly from a lower surface of the first lid 310. The lip 311 of the first lid 310 may be contoured with the gasket 134 of the collapsible portion 100. As shown in FIGS. 3C and 3D, when the lid 310 closes the container 10, the lip 311 presses the gasket 134 and thereby forms a compression fit to seal the container 10. In this position, the gasket 134 may be deformed by the lip 311 due to a downward pressure on the gasket 134. The lid 310 may further form a hinge 250 with the lid base 200 (as shown in FIG. 3A). The lid 310 may include a connector 313 configured to be connected with a pivot of the hinge 250 of the lid base 200, such that the lid 310 can pivot about the hinge 250 to close or open the container 10.

Optionally, the lid assembly 300 may further include a second lid 340 as shown in FIGS. 1B and 2A. The area of the second lid 340 may be smaller than the area of the first lid 310. The second lid 340 may be situated within the first lid 310. The second lid 340 may include a pivot 341 connected to the first lid 310. The pivot 341 may be received by one or more concaves 314 on the first lid 310 (as shown in FIG. 2C). The two concaves 314 may be elevated above the common plain of the first lid 310. Correspondingly, the first lid 310 may form an opening 315, which receive a bump 342 of the second lid 340. The bottom of the bump 342 may extend into the opening 315 and be aligned with the bottom of the first lid 310 when the second lid 340 closes the container 10, as shown in FIG. 3C. The second lid 340 may have a periphery 343, extending radially outward from the opening 315 and the bump 342.

Further, the first lid 310 may include an annular protrusion 316 around the opening 315 as shown in FIG. 2C. The annular protrusion 316 defines a channel 317 surrounding the annular protrusion 316. The lid assembly 300 may further include a ring 330 as shown in FIGS. 2B and 3C. The ring 330 includes an inner wall 332 and an outer wall 331, which define a channel 333 therebetween, as shown in FIG. 2B. The inner wall 332 may be longer than the outer wall 331 and/or end at a lower level than the outer wall 331. The ring 330 may further include a ramp 334 connected between the inner wall 332 and the outer wall 331. The channel 333 of the ring 330 receives the protrusion 316 of the first lid 310, and the outer wall 331 of the ring 330 is received by the channel 317 of the first lid 310. The protrusion 316 may be sandwiched by the inner wall 332 and outer wall 331. The ring 330 may be made of silicone or other material having a rigidity less that the rigidity of the first lid 310 and/or second lid 340, such that the ring 330 may be deformed to help the engagement of the first lid 310 and the second lid 340 to form a sealed connection.

Exemplarily, the collapsible portion 100 and the container base 400 can be made of silicone and be of a unitary construction. The lid base 200, the ring 240, the first lid 310, the second lid 340, and the ring 330 can be made of polypropylene, or other material having a rigidity higher than the rigidity of the collapsible portion 100. The lid base 200, the ring 240, the first lid 310, the second lid 340, and the ring 330 can be made of silicone.

FIGS. 4A-4E and 5A-5F show two additional embodiments of containers of this disclosure. The containers 20, 30 here may have different dimensions, such as different width-length ratios, heights, widths, and capacities from container 100. The lid assembly 300 of the containers 20, 30 may optionally have only one lid 310, but an additional lid 320. The containers 10, 20, 30 may further include scales to tell the amount of content in the containers. The containers 20, 30 mostly share the same functions and structures with container 10.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment," "an embodiment," "one aspect," or "an aspect" can mean that a particular feature, structure, or characteristic described in connection with a particular embodiment can be included in at least one embodiment of claimed subject matter. Thus, appearances of the phrase "in one embodiment," "an embodiment," "in on aspect," or "an aspect," in various places throughout this specification are not necessarily intended to refer to the same embodiment or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

What is claimed is:

1. A container, comprising:

a collapsible portion, including:

a first step structure;

a second step structure; and a hinge assembly coupled between the first step structure and the second step structure;

a lid base comprising an annular channel surrounded by an outer wall, the lid base is coupled to the collapsible portion;

a ring comprising an annular lip extending downward, the annular lip comprising protrusions extending from an outer surface of the annular lip, wherein the ring is coupled to the lid base and sandwiching a periphery of the collapsible portion with the lid base, wherein an inner surface of the outer wall of the lid base includes cuttings that are configured to receive the protrusions extending from the outer surface of the annular lip of the ring to form a snap-fit connection between the ring and the lid base such that the ring is mounted on and in contact with the lid base and compresses the periphery of the collapsible portion into the annular channel;

a lid assembly, coupled to the ring when the container is in a closed status, wherein the lid assembly directly contacts at least a portion of the collapsible portion when the container is in the closed status; and a container base, coupled to the collapsible portion, wherein:

each of the first step structure and the second step structure comprises:

an upper sidewall;

a transverse step; and a lower sidewall, the transverse step coupled between the upper sidewall and the lower sidewall, the transverse step of the second step structure being in a direct contact with the hinge assembly or the lower sidewall of the first step structure when the container is in a collapsed status; and the container base is not compressible.

2. The container of claim 1, wherein the hinge assembly comprises an intermediate structure, having a first end and a second end opposite to the first end, the intermediate structure being coupled to the first step structure and defining a first living hinge at the first end, the intermediate structure being coupled to the second step structure and defining a second living hinge at the second end.

3. The container of claim 2, wherein the intermediate structure is thinner than the first step structure and the second step structure.

4. The container of claim 2, wherein the intermediate structure has a largest thickness in the middle of the intermediate structure.

5. The container of claim 2, wherein the intermediate structure is angled relatively to the first step structure and the second step structure when the container is collapsed.

6. The container of claim 2, wherein the first end of the intermediate structure is coupled to an outer periphery of the first step structure and the second end of the intermediate structure is coupled to an inner periphery of the second step structure.

7. The container of claim 1, wherein the lower sidewall of the first step structure touches an upper surface of the transverse step of the second step structure and/or the upper sidewall of the second step structure touches a lower surface of the transverse step of the first step structure when the container is in a collapsed status.

8. The container of claim 1, a vertical projection along a depth axis of the container of the lower sidewall of the first step structure is on the transverse step of the second step structure and/or a vertical projection along the depth axis of the container of the upper sidewall of the second step structure is on the transverse step of the first step structure.

9. The container of claim 1, wherein the lower sidewall of the first step structure and the upper sidewall of the second step structure sandwiches the hinge assembly when the collapsible portion is in a collapsed status.

10. The container of claim 1, wherein the upper sidewall and the lower sidewall are perpendicular to the transverse step.

11. The container of claim 1, wherein a top surface of the container base touches the transverse step of the second step structure when the container is collapsed.

12. A container, comprising:

a container base;

a collapsible portion, coupled to the container base;

a lid base, coupled to the collapsible portion;

a ring comprising an annular lip extending downward, the annular lip comprising protrusions extending from an outer surface of the annular lip, wherein the ring is coupled to the lid base and sandwiching a periphery of the collapsible portion with the lid base; and a lid assembly, coupled to the ring when the container is in a closed status, wherein the lid base has an annular channel surrounded by an outer wall, the annular channel is contoured with the periphery of the collapsible portion, the channel receiving the periphery of the collapsible portion and wherein an inner surface of the outer wall of the lid base includes cuttings that are configured to receive the protrusions extending from the outer surface of the annular lip of the ring to form a snap-fit connection between the ring and the lid base such that the ring is mounted on and in contact with the lid base and compresses the periphery of the collapsible portion into the channel, wherein the collapsible portion has an annular gasket disposed at the periphery of the collapsible portion, and wherein the lid assembly directly contacts the annular gasket of the collapsible portion when the container is in the closed status.

13. The container of claim 12, wherein the annular lip of the ring compresses the periphery of the collapsible portion.

14. The container of claim 13, wherein the annular lip of the ring surrounds the annular gasket of the collapsible portion.

15. The container of claim 12, wherein the lid assembly has an annular lip extending downwardly and the annular lip of the lid assembly compresses the annular gasket of the collapsible portion when the container is in the closed status.

16. The container of claim 15, wherein the lid base further comprises an inner wall, the inner wall of the lid base sandwiches the annular gasket of the collapsible portion with the annular lip of the lid assembly, and the inner wall of the lid base sandwiches an annular lip of the periphery of the collapsible portion with the outer wall of the lid base.

17. The container of claim 12, wherein the lid assembly has an annular lip extending downwardly and compressing the annular gasket when the container is in the closed status, a first thickness of the annular gasket at an outer portion of the annular gasket is larger than a thickness of the annular gasket at an inner portion of the annular gasket.

18. A container, comprising:

a container base;

a collapsible portion, coupled to the container base;

a lid base, coupled to the collapsible portion;

a ring comprising an annular lip extending downward, wherein the ring is coupled to the lid base and sandwiching a periphery of the collapsible portion with the lid base; and a lid assembly, coupled to the ring when the container is in a closed status, wherein the lid base has an annular channel surrounded by an outer wall, the annular channel is contoured with the periphery of the collapsible portion, the channel receiving the periphery of the collapsible portion, wherein the ring includes a protrusion extending from an outer surface of the annular lip, the lid base includes a cutting formed in an inner surface of the outer wall, and the cutting receives the protrusion to form a snap-fit connection between the ring and the lid base.

19. The container of claim 18, wherein the collapsible portion has an annular gasket disposed at the periphery of the collapsible portion, and wherein the lid assembly directly contacts the annular gasket of the collapsible portion when the container is in the closed status.

20. The container of claim 18, wherein the collapsible portion includes an annular groove, the annular groove receives an inner wall of the lid base, the inner wall defining the channel with an outer wall of the lid base.

21. The container of claim 20, wherein the channel and the groove face two opposite directions.

* * * * *